US006704540B2

(12) United States Patent
Maeshima et al.

(10) Patent No.: US 6,704,540 B2
(45) Date of Patent: Mar. 9, 2004

(54) CLEANING DEVICE OF IMAGE FORMING MACHINE

(75) Inventors: Masanobu Maeshima, Osaka (JP); Naoki Yamane, Osaka (JP)

(73) Assignees: Kyocera Mita Corporation, Osaka (JP); Kyocera Corporation, Kyoto (JP)

( * ) Notice: Subject to any disclaimer, the term of this patent is extended or adjusted under 35 U.S.C. 154(b) by 0 days.

(21) Appl. No.: 10/227,454

(22) Filed: Aug. 26, 2002

(65) Prior Publication Data

US 2003/0059236 A1 Mar. 27, 2003

(30) Foreign Application Priority Data

Sep. 27, 2001 (JP) ..... 2001-296777
Jun. 21, 2002 (JP) ..... 2002-181173

(51) Int. Cl.[7] ..... G03G 21/00
(52) U.S. Cl. ..... 399/357
(58) Field of Search ..... 399/357, 343, 399/123, 358; 15/256.51; 74/410

(56) References Cited

U.S. PATENT DOCUMENTS 3,927,575 A * 12/1975 Durand ..... 74/410
5,583,625 A * 12/1996 Kondoh ..... 399/358
5,660,076 A * 8/1997 Jonkka et al. ..... 74/410
5,797,078 A * 8/1998 Sass et al. ..... 399/357
6,317,579 B1 * 11/2001 Kawagishi

FOREIGN PATENT DOCUMENTS

JP 2000112309 A * 4/2000 ..... G03G/21/10
JP 2001282068 A * 10/2001 ..... G03G/21/10

* cited by examiner

*Primary Examiner*—Arthur T. Grimley
*Assistant Examiner*—Ryan Gleitz
(74) *Attorney, Agent, or Firm*—Smith, Gambrell & Russell, LLP

(57) ABSTRACT

A cleaning device of an image forming machine including a pair of arm members each having one end portion pivotable about a support shaft, a cleaning roller rotatably supported between front end portions of the arm members via a shaft, helical compression springs for urging the arm members so as to bring the cleaning roller into contact under pressure with the surface of a photoconductor drum, a drive gear of the photoconductor drum, and a driven gear of the cleaning roller in mesh with the drive gear. Each of the arm members is disposed axially outwardly of the photoconductor drum. The center of the support shaft of each of the arm members is either placed on an extension of a line of action passing the point of engagement between the drive gear and the driven gear, or placed on an extension of a straight line passing the point of engagement, the straight line being within an angular range of some angle to the line of action.

4 Claims, 8 Drawing Sheets

CLEANING DEVICE OF IMAGE FORMING MACHINE

FIELD OF THE INVENTION

This invention relates to a cleaning device which is applied to an image forming machine, such as an electrostatic copier, a laser printer, or a facsimile, especially, an image forming machine equipped with an a-Si-based (amorphous silicon-based) photoconductor drum.

DESCRIPTION OF THE PRIOR ART

Image forming machines, for example, printers, using an a-Si-based photoconductor drum have been put to practical use. An a-Si material as a photoconductor is characterized by relative hardness and a long life, but after long-term use, is prone to leakage of electric charges, causing a disturbance to a toner image. To prevent this disturbance in the toner image, a cleaning roller is disposed in a cleaning device, and is in constant contact under pressure with the surface of a photoconductor drum to polish the surface of the photoconductor drum. The cleaning roller is formed from foamed synthetic rubber. A cleaning device provided with such a cleaning roller is disclosed, for example, in Japanese Unexamined Patent Publication No. 2000-112309. The cleaning device disclosed in this publication comprises a pair of arm members each having an intermediate portion pivotable about a support shaft, a cleaning roller rotatably supported between the front ends of the arm members via a shaft, helical tension springs for urging the other ends of the arm members so as to bring the cleaning roller into contact under pressure with the surface of an a-Si-based photoconductor drum, a drive gear integral with the photoconductor drum, and a driven gear integral with the cleaning roller and in mesh with the drive gear. A straight line connecting the support shaft (fulcrum) in each of the arm members and the shaft (point of action) of the cleaning roller is placed on a line nearly parallel to the line of action at the point of engagement between the drive gear and the driven gear (i.e., the line of action in the direction of transmission of force). A configuration in which the position of this support shaft (fulcrum) is slightly displaced from the parallel line is also disclosed in the publication.

In a printer having the cleaning device disclosed in the above-mentioned publication, a sheet transport passage extending through a transfer zone of the photoconductor drum may be disposed so as to extend substantially in an up-and-down direction in the transfer zone. In this case, the printing time from the start of printing to the completion of printing can be shortened, because the total length of the sheet transport passage is smaller than when the sheet transport passage is disposed so as to extend substantially in a lateral direction (horizontal direction) in the transfer zone. As a result, the long life and high speed of the printer can both be achieved. However, if the sheet transport passage is disposed in the cleaning device so as to extend substantially in the up-and-down direction in the transfer zone, the cleaning device is placed above the photoconductor drum. The support shaft (fulcrum) in each of the arm members, the other end of each of the arm members, and the helical tension springs urging the other ends are arranged downstream, in the direction of rotation of the photoconductor drum, from the position of the photoconductor drum in contact under pressure with the cleaning roller. Thus, they interfere with toner transport means disposed in the same region. To avoid this drawback, the support shaft (fulcrum) in each of the arm members has been placed upstream, in the direction of rotation of the photoconductor drum, from the position of the photoconductor drum in contact under pressure with the cleaning roller. In this case, it has been confirmed that an irregular drive due to a driving force by the drive gear occurs. Thus, a further improvement has been demanded.

SUMMARY OF THE INVENTION

An object of the present invention is to provide a novel cleaning device of an image forming machine, which prevents the occurrence of the irregular drive and permits compactness of the structure.

Another object of the present invention is to provide a novel cleaning device of an image forming machine, which prevents the occurrence of the irregular drive, permits compactness of the structure, and achieves both of the long life and high speed of the image forming machine.

According to the present invention, there is provided a cleaning device of an image forming machine, comprising:

- a pair of arm members each having one end portion pivotable about a support shaft;
- a cleaning roller rotatably supported between front end portions of the arm members via a shaft;
- spring means for urging each of the arm members so as to bring the cleaning roller into contact under pressure with a surface of a photoconductor drum;
- a drive gear integral with the photoconductor drum; and
- a driven gear integral with the shaft of the cleaning roller and in mesh with the drive gear, and wherein
  - each of the arm members is disposed axially outwardly of the photoconductor drum, and
- a center of the support shaft of each of the arm members is either placed on an extension of a line of action passing a point of engagement between the drive gear and the driven gear, or placed on an extension of a straight line passing the point of engagement, the straight line being within an angular range of some angle to the line of action.

Preferably, the center of the support shaft of each of the arm members is placed on the extension of the straight line passing the point of engagement, the straight line being within the angular range of ±10° to the line of action.

Preferably, the drive gear is disposed at one end in the axial direction of the photoconductor drum, one of the arm members is disposed axially outwardly of the drive gear, and the driven gear is disposed in a region in the shaft of the cleaning roller which is located between the one arm member and one end in the axial direction of the cleaning roller.

Preferably, the spring means comprise a pair of helical compression springs, and each of the helical compression springs is disposed so as to act on a region in the corresponding arm member which is located between the support shaft and the shaft of the cleaning roller.

Preferably, a sheet transport passage passing through a transfer zone of the photoconductor drum extends substantially in an up-and-down direction in the transfer zone, the shaft of the cleaning roller is disposed downstream from the transfer zone of the photoconductor drum and above the photoconductor drum, toner transport means is disposed downstream, in the direction of rotation of the photoconductor drum, from a position of the photoconductor drum in contact under pressure with the cleaning roller, and is disposed above the photoconductor drum, and the support shaft of each of the arm members is disposed upstream, in the direction of rotation of the photoconductor drum, from the position of the photoconductor drum in contact under pressure with the cleaning roller.

DETAILED DESCRIPTION OF THE PREFERRED EMBODIMENTS

Figure 1:
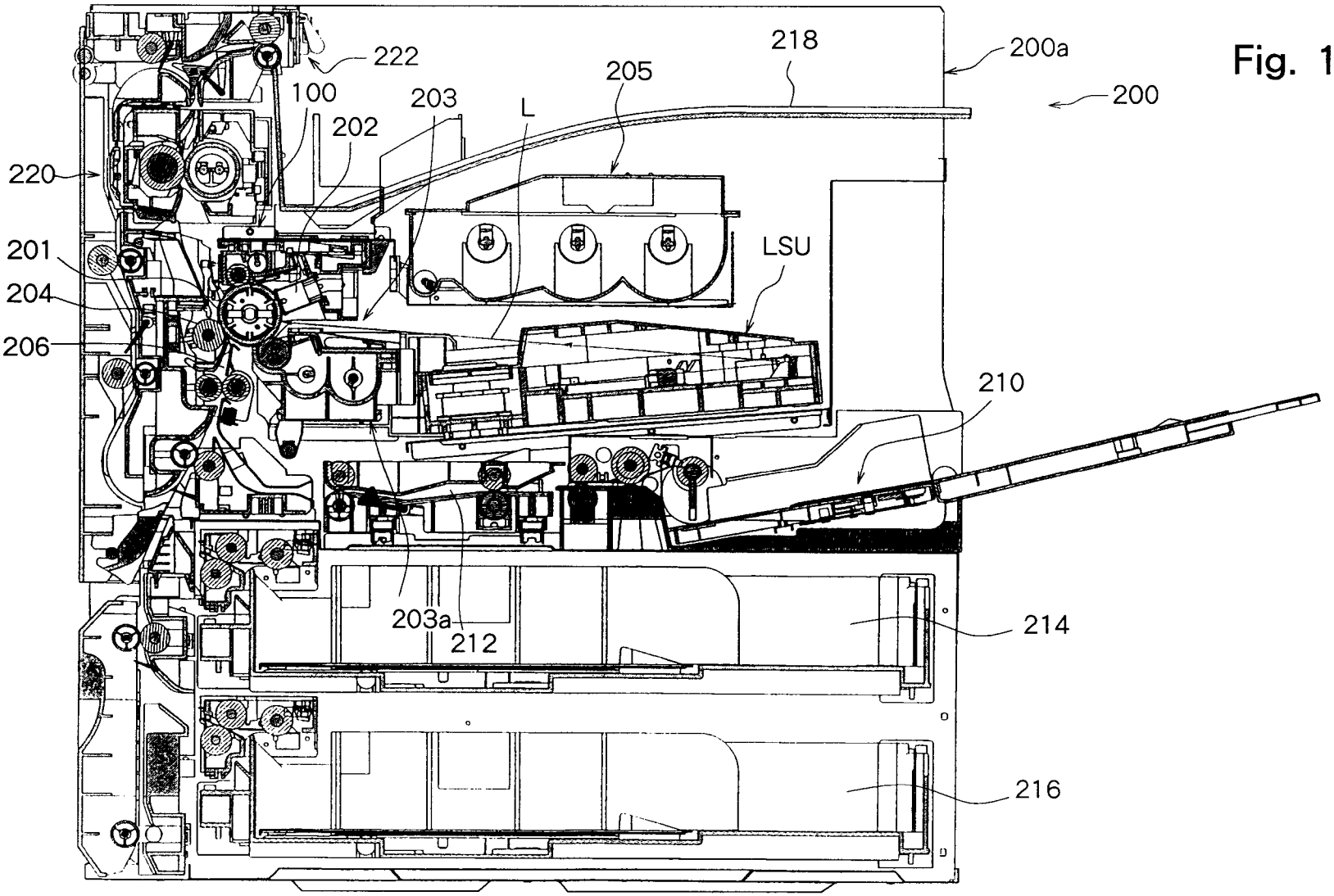
FIG. 1 is a sectional front view of the configuration of a laser printer equipped with an embodiment of a cleaning device according to the present invention.

Preferred embodiments of a cleaning device of a laser printer, which is an image forming machine, constituted in accordance with the present invention will now be described in detail with reference to the accompanying drawings. With reference to FIG. 1, a laser printer entirely indicated at the numeral 200 has a printer body 200*a* of a nearly rectangular parallelopipedal shape. When the printer body 200*a* is viewed from front, an a-Si-based photoconductor drum 201 is disposed at a position close to one end in a right-and-left direction within the printer body 200*a*, namely, at a position close to the left end in FIG. 1, and at a position above the center in an up-and-down direction within the printer body 200*a*. Around the photoconductor drum 201 within the printer body 200*a*, there are disposed a main charger 202 for uniformly charging the surface of the photoconductor drum 201 to a predetermined polarity, a laser scanning unit LSU for scanning the uniformly charged surface of the photoconductor drum 201 with laser light corresponding to image information to form an electrostatic latent image, a developing device 203 for developing the electrostatic latent image formed on the surface of the photoconductor drum 201 to a toner image, a transfer roller 204 as transfer means for transferring the toner image developed on the surface of the photoconductor drum 201 to paper such as plain paper, and a cleaning device 100 to be described in detail later. The developing device 203 has a development housing 203*a*, and a toner container 205, etc. for feeding a developer into the development housing 203*a*. A sheet transport passage 206 is disposed within the printer body 200*a*. The sheet transport passage 206 passes through a transfer zone formed on the surface of the photoconductor drum 201 in cooperation with the transfer roller 204, and extends substantially in the up-and-down direction at least in the transfer zone.

The laser scanning unit LSU, which converts image information into laser light and irradiates the circumferential surface of the photoconductor drum 201 with the laser light, is disposed parallel to the development housing 203*a* at a position on the opposite side of the development housing 203*a* from the photoconductor drum 201 (i.e., at a position to the right of the development housing 203*a*), and at a position on practically the same height as the development housing 203*a*. The toner container 205 is disposed above, and spaced from, the laser scanning unit LSU. A partial region of the toner container 205 (concretely, the region where a toner outlet portion (not shown) is disposed) is located so as to be present above a partial region of the development housing 203*a*. A manual sheet feed tray 210 is disposed at a position immediately below the laser scanning unit LSU, and in a right end portion in FIG. 1 within the printer body 200*a*. A feeder portion of the manual sheet feed tray 210 is connected to the sheet transport passage 206 via a manual sheet feed transport passage 212 extending nearly horizontally at a position immediately below the development housing 203*a* and the laser scanning unit LSU. Sheet feeding cassettes 214 and 216 are arranged, one above the other and parallel to each other, at a position below the manual sheet feed tray 210 and the manual sheet feed transport passage 212. Feeder portions of the sheet feeding cassettes 214 and 216 are connected to the sheet transport passage 206. A delivery tray 218 is disposed above the toner container 205. A fixing device 220 and a delivery roller pair 222 are disposed in a downstream end portion of the sheet transport passage 206 disposed so as to extend in a nearly vertical direction.

An optical path L of laser light directed from the laser scanning unit LSU onto the circumferential surface of the photoconductor drum 201 via reflectors, such as polygon mirrors, disposed inside is formed so as to pass through a gap between the upper surface of the development housing 203*a* and the lower surfaces of the toner container 205 and the main charger 202. In the embodiment, the optical path L is set to extend in a slightly upwardly inclined manner, relative to a horizontal line, toward the circumferential surface of the photoconductor drum 201. Image information supplied from the outside to the laser scanning unit LSU is converted to laser light, and directed onto the circumferential surface of the photoconductor drum 201 to form an electrostatic latent image on the circumferential surface. This electrostatic latent image is developed to a toner image by the developing device 203. The developed toner image is transferred, in the transfer zone, to a sheet fed and transported, for example, from the sheet feeding cassette 214 through the sheet transport passage 206. The toner image transferred onto the sheet is fixed at the fixing device 220, and the sheet having the toner image fixed thereon is delivered onto the delivery tray 218 by the delivery roller pair 222. In roughly the above-described manner, a printing action by the printer 200 is performed repeatedly to produce prints. In the machine of the configuration shown in FIG. 1, a document feeder may be provided on the upper surface of the body, an image reader may be provided within an upper end portion of the printer body 200*a* in correspondence with the document feeder so that the image of the document fed by the document feeder is read by the image reader, and the laser scanning unit LSU may be actuated based on the image information read. In this case, the machine can be utilized as an electrostatic copier.

Figure 2:
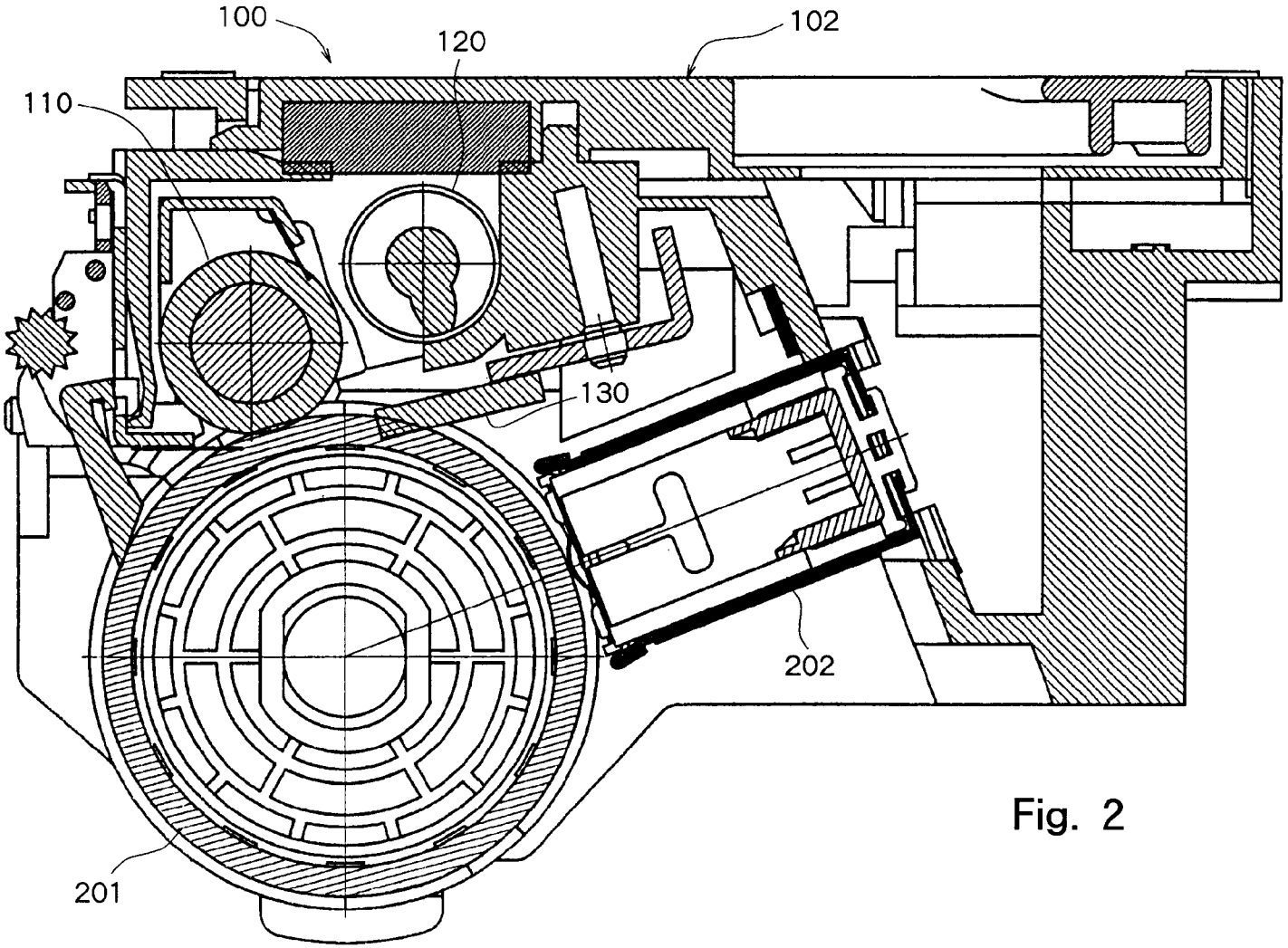
FIG. 2 is an enlarged sectional view of the cleaning device shown in FIG. 1, illustrated together with a photoconductor drum.
Figure 3:
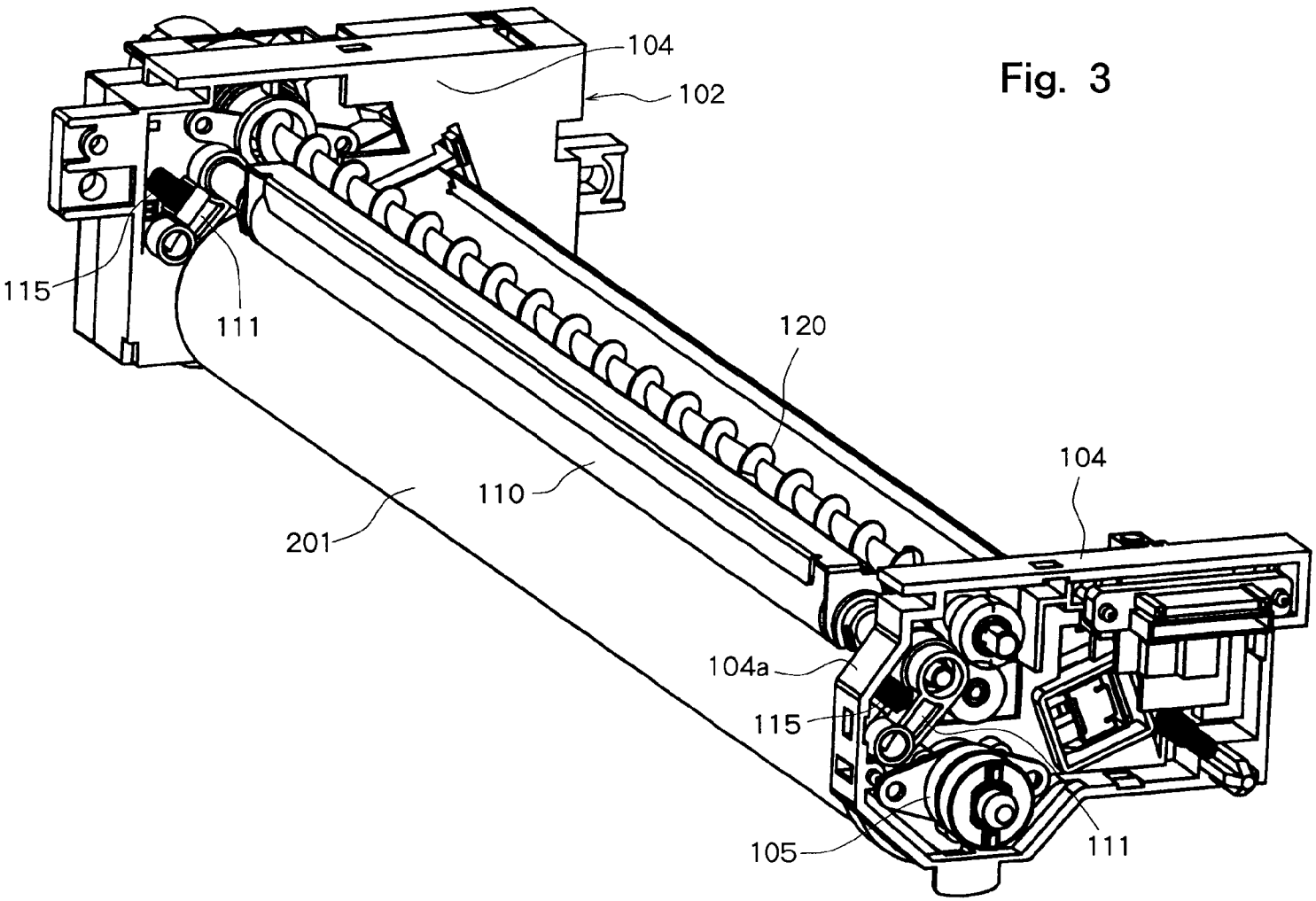
FIG. 3 is a perspective view, partly omitted, of a drum unit.
Figure 4:
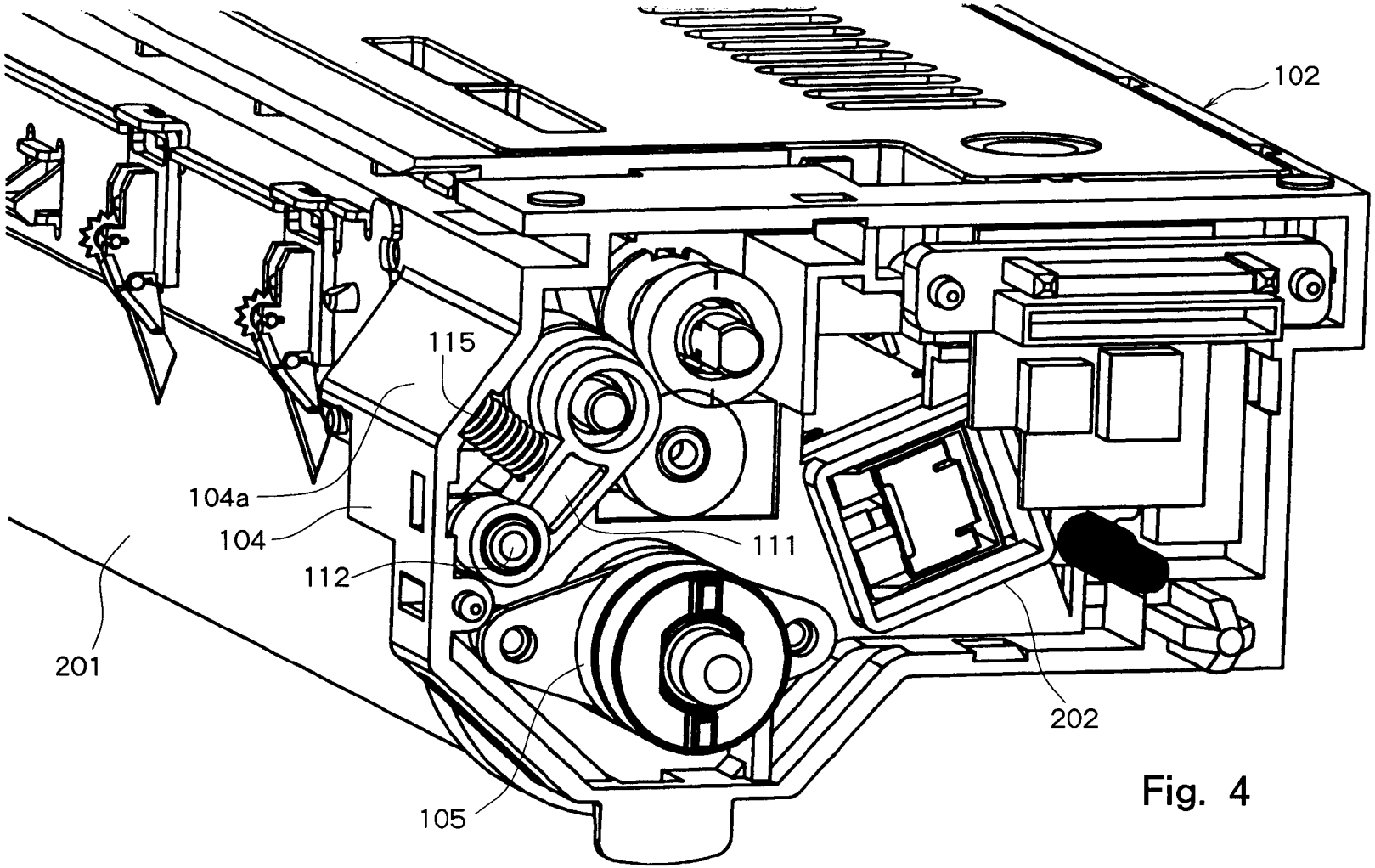
FIG. 4 is a perspective view showing one end portion of the drum unit.
Figure 5:
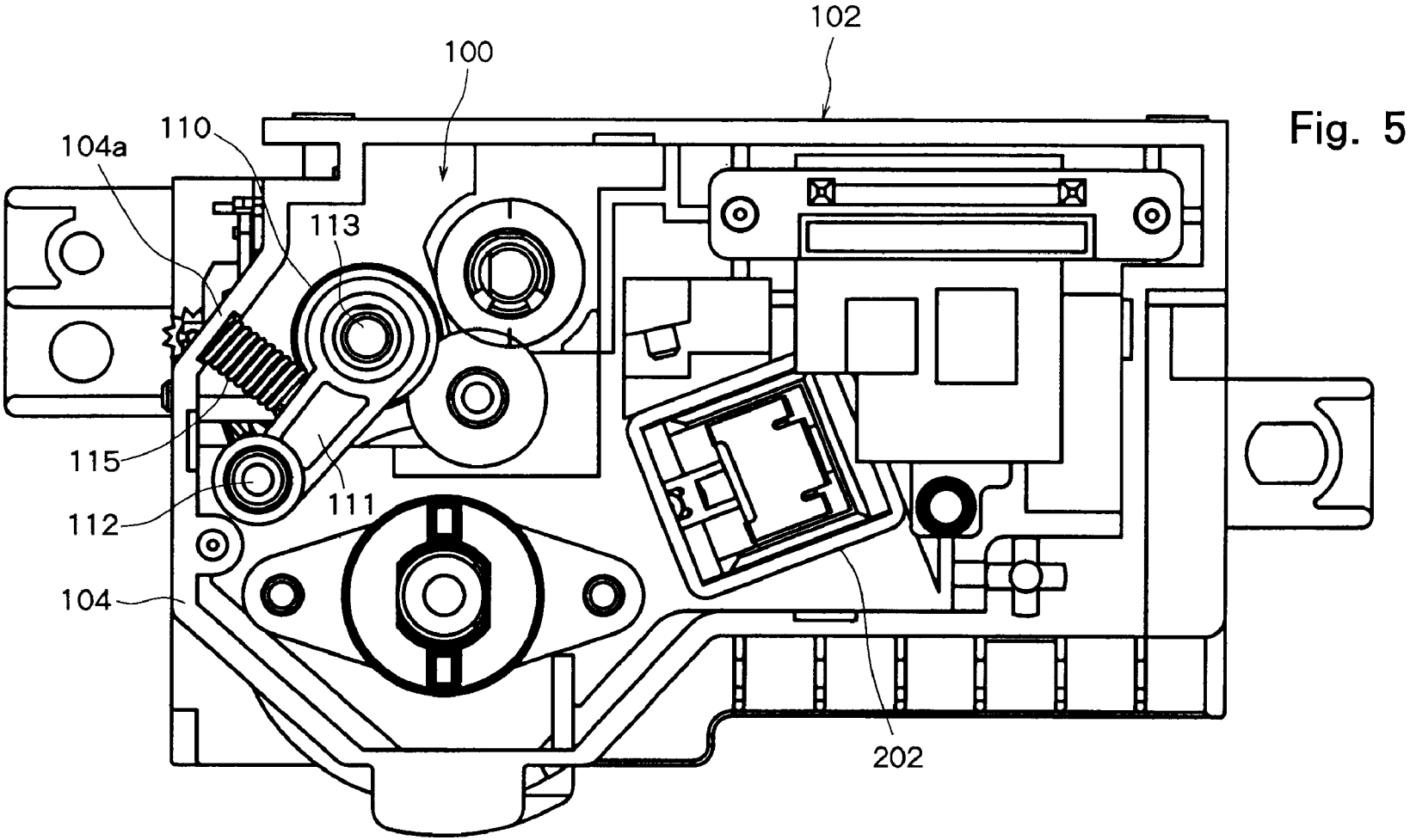
FIG. 5 is a side view of the drum unit shown in FIG. 4, as viewed in the axial direction of the photoconductor drum.

Next, the cleaning device 100 according to the present invention, which is installed in the printer 200, will be described. With reference to FIGS. 2 and 3, the cleaning device 100 and the photoconductor drum 201 are mounted on a framework 102. The framework 102 has a pair of side frames 104 opposed to each other with spacing, and a connecting frame (not shown) extending between the side frames 104 so as to connect the side frames 104 integrally. The photoconductor drum 201 is rotatably supported between the side frames 104. The cleaning device 100 has a cleaning roller 110, a toner transport member 120 as toner transport means, and a cleaning blade 130. The framework 102, the cleaning device 100, and the photoconductor drum 201 constitute a wholly integral drum unit.

With reference to FIGS. 3 to 6, the photoconductor drum 201 is rotatably supported on the side frames 104 via bearings 105. A drive gear 201*a* (see FIG. 6) is integrally disposed at one end in the axial direction of the photoconductor drum 201. A pair of arm members 111 are disposed on external sides in the axial direction of the side frames 104. Each of the arm members 111 has one end supported so as to be pivotable about a support shaft 112 protruding laterally outwardly from the side frame 104. The cleaning roller 110 is rotatably supported between the other ends (front ends) of the arm members 111 via a shaft 113. The cleaning roller 110, comprising foamed synthetic rubber, for example, a foam of EPDM, is integrally mounted on the shaft 113, and the shaft 113 is rotatably supported by the opposite ends of the arm members 111 via bearings (not shown). Each of the arm members 111 is disposed axially outwardly of the photoconductor drum 201, and one of the arm members 111 is disposed axially outwardly of the drive gear 201*a* of the photoconductor drum 201. A driven gear 114 is integrally connected to one end portion of the shaft 113 of the cleaning roller 110. The driven gear 114 is disposed in that region in the shaft 113 of the cleaning roller 110 which lies between the one arm member 111 (the arm member 111 disposed on the right in FIG. 6) and one end 110*a* (see FIG. 6) in the axial direction of the cleaning roller 110.

Helical compression springs 115 as spring means are disposed between each of the arm members 111 and the flange portions 104*a* formed in the side frames 104. Each of the flange portions 104*a* protrudes laterally outwardly from one side edge of the corresponding side frame 104. Each of the helical compression springs 115 is disposed such that one end thereof acts on that region in the corresponding arm member 111 which is present between the support shaft 112 and the shaft 113 of the cleaning roller 110. Each of the arm members 111 is urged by the corresponding helical compression spring 115 so as to turn clockwise about the support shaft 112 in FIGS. 3 to 6. Thus, the surface of the cleaning roller 110 is contacted under pressure with the surface of the photoconductor drum 201. Simultaneously, the driven gear 114 of the cleaning roller 110 is meshed with the drive gear 201*a* of the photoconductor drum 210.

Figure 6:
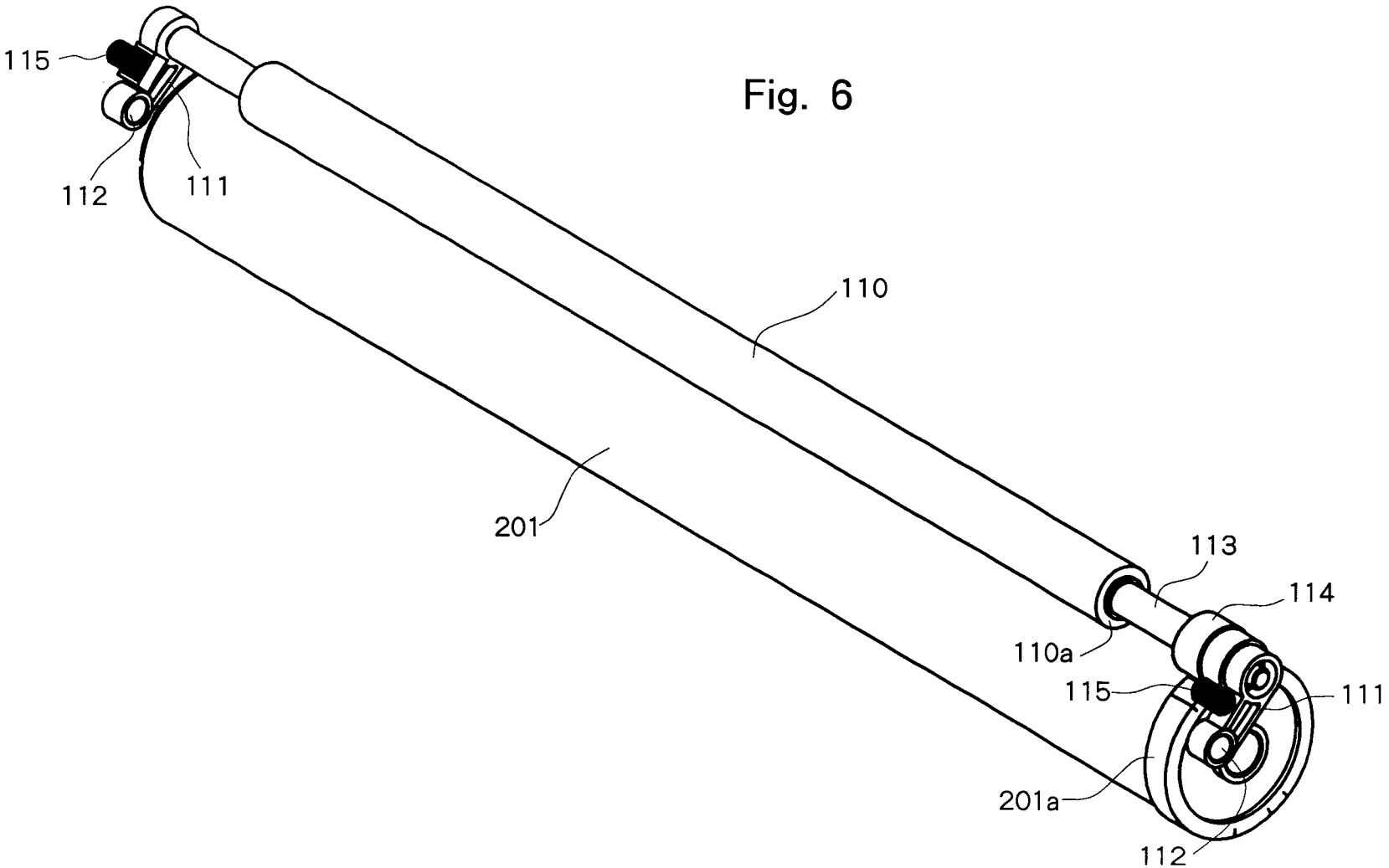
FIG. 6 is a perspective view partially showing the photoconductor drum and a support mechanism for a cleaning roller.
Figure 7:
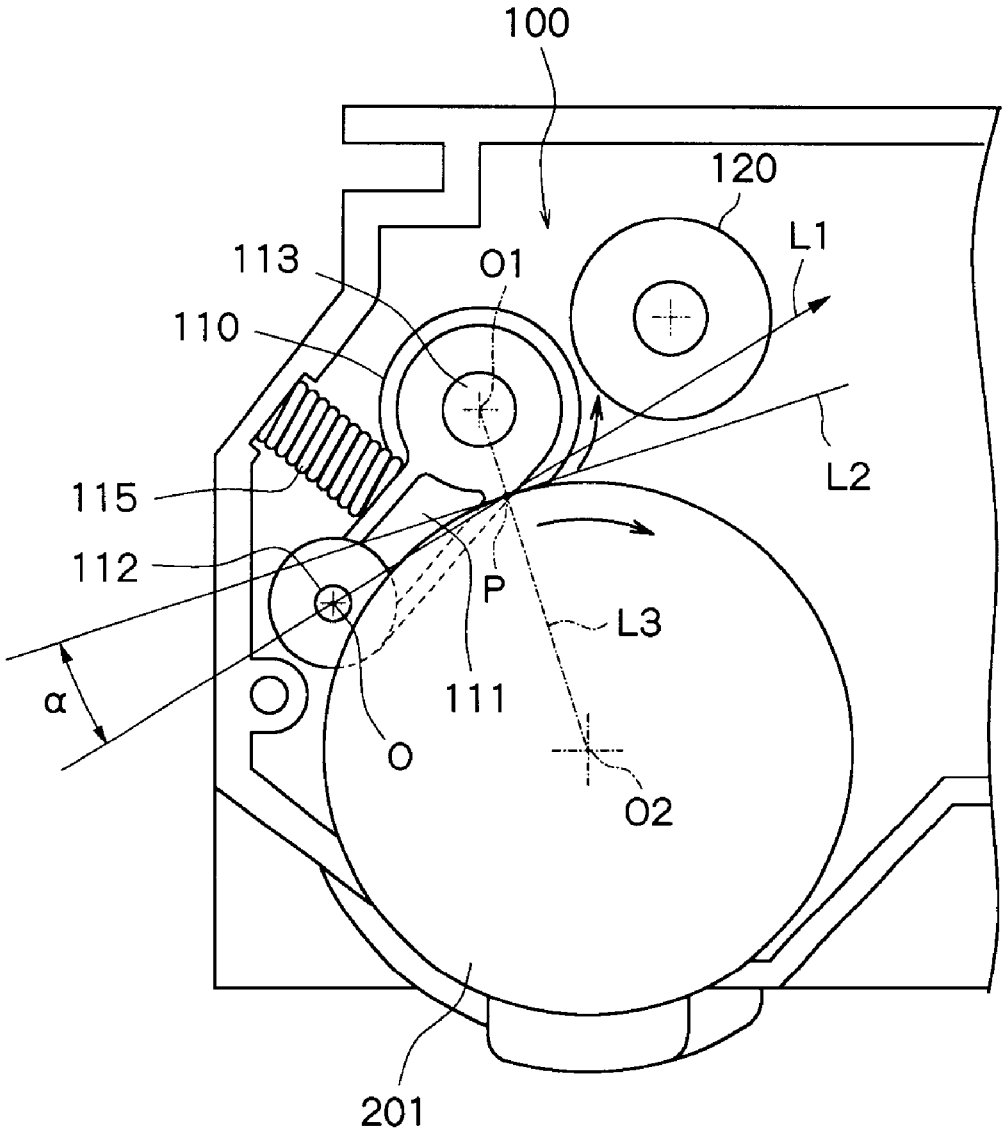
FIG. 7 is a schematic view showing the configuration of the support mechanism for the cleaning roller.
Figure 8:
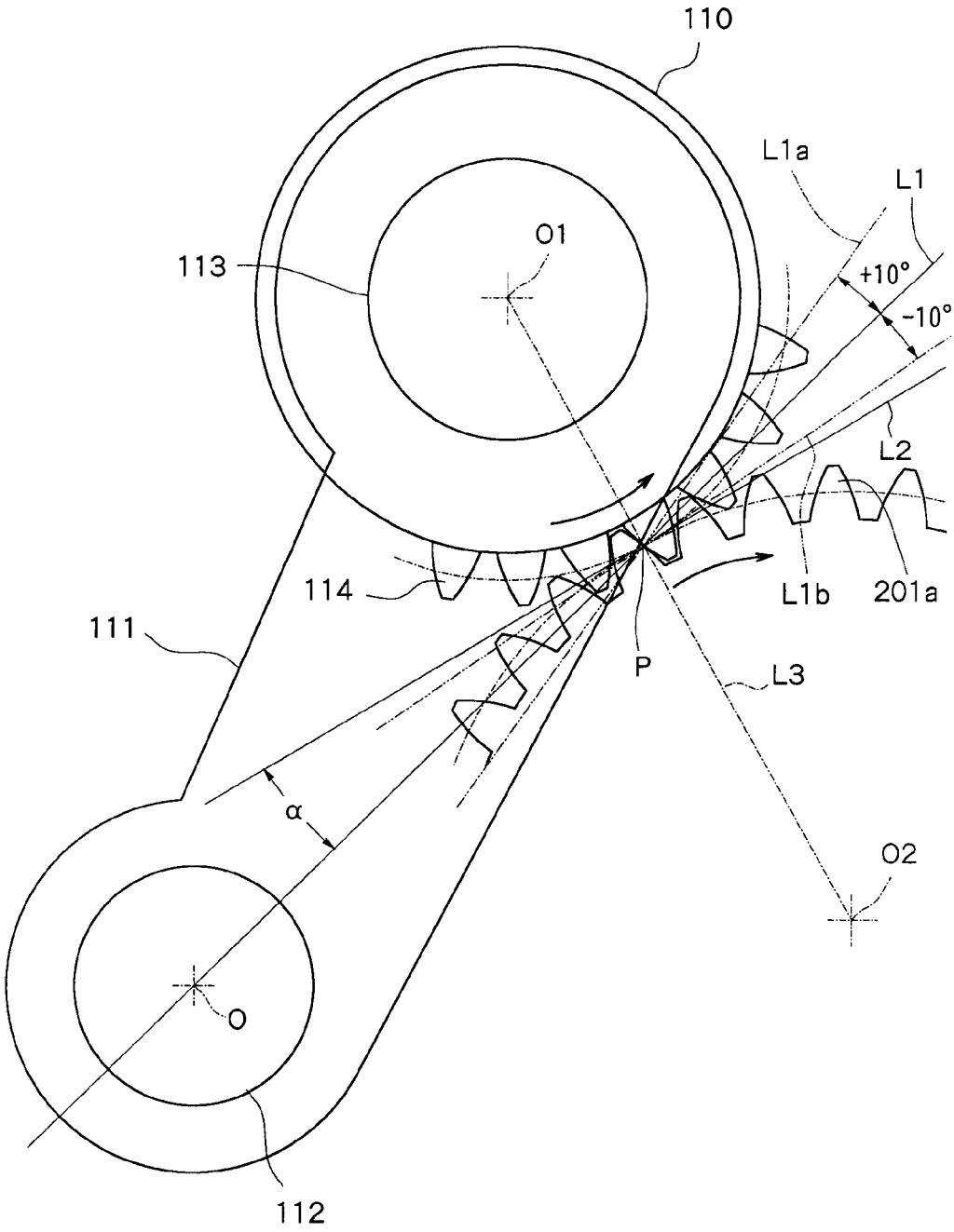
FIG. 8 is a schematic view showing the positional relationship between the center of a support shaft of an arm member and a line of action passing a point of engagement between a drive gear and a driven gear in FIG. 7.

With reference to FIGS. 6 to 8, when the cleaning device 100 is viewed in the axial direction of the photoconductor drum 201, the center O of the support shaft 112 of each of the arm members 111 is placed on an extension of a line of action, L1, passing a point of engagement (pitch point), P, between the driven gear 114 of the cleaning roller 110 and the drive gear 201*a* of the photoconductor drum 210. In FIGS. 7 and 8, the symbol L3 denotes a straight line passing the axial center O1 of the driven gear 114 and the axial center O2 of the drive gear 201*a*. The symbol L2 denotes a straight line intersecting the straight line L3 at right angles, and a tangent to the pitch circles of the driven gear 114 and the drive gear 201*a*. An angle $\alpha$ formed by the intersection of the line of action L1 [a normal to the point of contact, P, (i.e., pitch point) of the tooth flanks of the driven gear 114 and the drive gear 201*a* in mesh] and the tangent L2 constitutes a pressure angle. In FIGS. 6 and 8, the direction of rotation of the drive gear 201*a* of the photoconductor drum 210 is clockwise, so that the direction of rotation of the driven gear 114 of the cleaning roller 110 is counterclockwise. Thus, a driving force acts in the direction in which the driving pressure of the drive gear 201*a* works, namely, in the direction of the line of action L1 (the direction of an arrow along the line of action L1 in FIGS. 7 and 8). As stated earlier, the center O of the support shaft 112 of each of the arm members 111 is placed on an extension of the line of action L1 at the point of engagement P between the driven gear 114 of the cleaning roller 110 and the drive gear 201*a* of the photoconductor drum 210 (in the embodiment, an extension of L1 in the direction directly opposite to the direction of the driving force of the drive gear 201*a*). Thus, the turning moment about the support shaft 112 of each of the arm members 111 produced by the helical compression spring 115 is prevented from fluctuating under the influence of the driving force of the drive gear 201*a*. As a result, the occurrence of an irregular drive is reliably prevented. Thus, the stable polishing of the surface of the photoconductor drum 201 by the cleaning roller 110 is ensured, making it possible to form the image stably and prolong the life of the photoconductor drum. Furthermore, each of the arm members 111 is disposed axially outwardly of the photoconductor drum 201. Hence, the entire structure is compact, although the center O of the support shaft 112 of each of the arm members 111 is placed on the extension of the line of action L1 at the point of engagement P between the driven gear 114 of the cleaning roller 110 and the drive gear 201*a* of the photoconductor drum 210. Besides, the length of each of the arm members 111 can be shortened.

As described earlier, moreover, the drive gear 201*a* of the photoconductor drum 201 is disposed at one end in the axial direction of the photoconductor drum 201, one of the arm members 111 is disposed axially outwardly of the drive gear 201*a*, and the driven gear 114 of the cleaning roller 110 is disposed in that region in the shaft 113 of the cleaning roller 110 which lies between the one arm member 111 and one end in the axial direction of the cleaning roller 110 (see FIG. 6). Thus, the support for the driven gear 114 is not in a cantilevered state, so that vibrations of the driven gear 114 and the cleaning roller 110 are suppressed, and an irregular drive due to the vibrations can be prevented.

As described above, each of the helical compression springs 115 is disposed so as to act on that region in the corresponding arm member 111 which is located between the support shaft 112 and the shaft 113 of the cleaning roller 110. Thus, the length of the arm member 111 can be shortened, and the space in the direction of this length can be decreased, thus achieving a compact entire configuration.

In the embodiment shown in FIG. 1, the sheet transport passage 206 passing through the transfer zone of the a-Si-based photoconductor drum 201 extends substantially in the up-and-down direction in the transfer zone. As shown in FIG. 7, moreover, the shaft 113 of the cleaning roller 110 is disposed downstream from the transfer zone of the photoconductor drum 201, and above the photoconductor drum 201. A toner transport member 120, comprising a shaft and a helical blade, is disposed downstream, in the direction of rotation of the photoconductor drum 201, from a position of the photoconductor drum 201 in contact under pressure with the cleaning roller 110, and above the photoconductor drum 201. The support shaft 112 of each of the arm members 111 is disposed upstream, in the direction of rotation of the photoconductor drum 201, from a position of the photoconductor drum 201 in contact under pressure with the cleaning roller 110. In the above embodiment, the use of the a-Si-based photoconductor drum 201 and the employment of the sheet vertical transport system make it possible to prevent the occurrence of the aforementioned irregular drive, make the configuration compact, and achieve the long life and high speed of the printer.

The cleaning device 100 of the present invention can be applied to an image forming machine adopting the lateral transport system for sheets, namely, an image forming machine of a configuration in which the sheet transport passage passing through the transfer zone of the photoconductor drum 201 extends substantially laterally (horizontally) in the transfer zone. In the illustrated embodiment, the center O of the support shaft 112 of each of the arm members 111 is placed on the extension of the line of action L1 at the point of engagement P (pitch point) between the drive gear 201*a* and the driven gear 114, and is also placed on the line of action L1 in the direction directly opposite to the direction in which the driving force acts at the point of engagement P (see the arrow directed in an obliquely upper right direction in FIGS. 7 and 8). However, there may be an embodiment in which the center O is placed on the line of action L1 in the direction in which the driving force acts at the point of engagement P. In this embodiment, the toner transport member 120 needs to be disposed at a position where the toner transport member 120 does not interfere with each of the arm members 111 and/or the support shaft 112, the helical compression spring 115 or the like. This embodiment can obtain, at least, the effect that the occurrence of an irregular drive is reliably prevented. In the embodiment, moreover, the center O of the support shaft 112 of each of the arm members 111 is placed on the extension of the line of action L1 passing the point of engagement P between the driven gear 114 of the cleaning roller 110 and the drive gear 201*a* of the photoconductor drum 210. However, other embodiments in which the center O is not placed on the extension of the line of action L1 also hold. That is, there holds other embodiment in which the center O of the support shaft 112 of each of the arm members 111 is placed on an extension of a straight line passing the point of engagement P between the driven gear 114 of the cleaning roller 110 and the drive gear 201*a* of the photoconductor drum 210, the straight line being within an angular range at ±10° to the line of action L1 (see FIG. 8). In FIG. 8, straight lines indicated by two-dot chain lines L1*a* and L1*b* correspond to such straight line forming angles of +10° and −10°, respectively, to the line of action L1. This embodiment, practically, is capable of achieving the effect that the turning moment about the support shaft 112 of each of the arm members 111 produced by the helical compression spring 115 is prevented from fluctuating under the influence of the driving force of the drive gear 201*a*. As a result, the occurrence of an irregular drive is prevented without causing problems to practical use. Thus, the stable polishing of the surface of the photoconductor drum 201 by the cleaning roller 110 is ensured, making it possible to form the image stably and prolong the life of the photoconductor drum.

That is, the center O of the support shaft 112 of each of the arm members 111 is either placed on the extension of the line of action L1 passing the point of engagement P between the drive gear 201*a* and the driven gear 114, or placed on an extension of a straight line passing the point of engagement P, the straight line falling within an angular range of some angle to the line of action L1. The expression "angular range of some angle", needless to say, refers to an angular range within which the occurrence of an irregular drive is prevented to a practically unproblematic level. According to the inventors' experience, the "angular range of some angle" may be an angular range of ±10°, as stated above. The cleaning device of the present invention is applied to an image forming machine equipped with an a-Si-based photoconductor drum as described earlier. However, this cleaning device can be used in an image forming machine having an OPC (Organic Photoconductor) drum.

With the aforementioned drum unit being mounted within the printer body 200*a*, the drive gear 201*a* of the photoconductor drum 201 is drivingly connected to an electric motor, a drive source, via other intermediate gears (not shown) disposed within the printer body 200*a*. With reference to FIGS. 2, 7 and 8, when the drive gear 201*a* is rotationally driven by the electric motor, the photoconductor drum 201 is rotationally driven clockwise in the drawings. The cleaning roller 110 is rotationally driven counterclockwise in the drawings via the driven gear 114. The cleaning roller 110 is brought into contact under pressure with the surface of the photoconductor drum 201 by the helical compression springs 115, and is set to have a slightly higher peripheral speed than does the photoconductor drum 201. Thus, the surface of the photoconductor drum 201 is constantly polished. The cleaning blade 130 scrapes toner, remaining on the surface of the photoconductor drum 201, from this surface. The toner transport member 120 transports the toner, scraped off the surface of the photoconductor drum 201, into a recovery container (not shown).

What we claim is:

1. A cleaning device of an image forming machine comprising:

a pair of arm members each having one end portion pivotable about a support shaft;

a cleaning roller rotatably supported between front end portions of the arm members via a shaft;

spring means for urging each of the arm members so as to bring the cleaning roller into contact under pressure with a surface of a photoconductor drum;

a drive gear integral with the photoconductor drum; and a driven gear integral with the shaft of the cleaning roller and in mesh with the drive gear, and wherein each of the arm members is disposed axially outwardly of the photoconductor drum, and a center of the support shaft of each of the arm members is placed on an extension of a straight line passing through a point of engagement between the drive gear and the driven gear, the straight line being within the angular range of ±10° to the line of action normal to the point of engagement.

2. The cleaning device of an image forming machine as claimed in claim 1, wherein the drive gear is disposed at one end in an axial direction of the photoconductor drum, one of the arm members is disposed axially outwardly of the drive gear, and the driven gear is disposed ma region in the shaft of the cleaning roller which is located between the one arm member and one end in an axial direction of the cleaning roller.

3. The cleaning device of an image forming machine as claimed in claim 1, wherein the spring means comprise a pair of helical compression springs, and each of the helical compression springs is disposed so as to act on a region in the corresponding arm member which is located between the support shaft and the shaft of the cleaning roller.

4. The cleaning device of an image forming machine as claimed in claim 1, wherein a sheet transport passage passing through a transfer zone of the photoconductor drum extends substantially in an up-and-down direction in the transfer zone, the shaft of the cleaning roller is disposed downstream from the transfer zone of the photoconductor drum and above the photoconductor drum, toner transport means is disposed downstream, in a direction of rotation of the photoconductor drum, from a position of the photoconductor drum in contact under pressure with the cleaning roller, and is disposed above the photoconductor drum, and the support shaft of each of the arm members is disposed upstream, in the direction of rotation of the photoconductor drum, from the position of the photoconductor drum in contact under pressure with the cleaning roller.

* * * * *